US007080579B2

(12) United States Patent
Chen

(10) Patent No.: US 7,080,579 B2
(45) **Date of Patent: *Jul. 25, 2006**

(54) RATCHET WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 97 days.

This patent is subject to a terminal disclaimer.

(21) Appl. No.: 10/648,205

(22) Filed: Aug. 27, 2003

(65) Prior Publication Data

US 2005/0011315 A1 Jan. 20, 2005

(30) Foreign Application Priority Data

Jul. 18, 2003 (TW) ..... 92119645 A

(51) Int. Cl.
*B25B 13/46* (2006.01)

(52) U.S. Cl. ..... 81/63.1; 81/60; 81/62; 192/43.2

(58) Field of Classification Search ..... 81/60–64; 192/43.2

See application file for complete search history.

(56) References Cited

U.S. PATENT DOCUMENTS 3,436,992 A * 4/1969 Over et al. ..... 81/63.1
5,913,954 A * 6/1999 Arnold et al. ..... 81/63.1
6,260,449 B1 * 7/2001 I-He ..... 81/63.1
6,282,992 B1 * 9/2001 Hu ..... 81/60
6,382,051 B1 * 5/2002 Chang ..... 81/60
6,408,722 B1 * 6/2002 Chen ..... 81/60
6,481,315 B1 * 11/2002 Chang et al. ..... 81/60
6,516,930 B1 * 2/2003 Chen ..... 192/43.2
6,691,594 B1 * 2/2004 Chen ..... 81/62
6,857,339 B1 * 2/2005 Chen ..... 81/63.1
2002/0023519 A1 * 2/2002 Hu ..... 81/63.2
2003/0136232 A1 * 7/2003 Chang ..... 81/60
2003/0213342 A1 * 11/2003 Wu ..... 81/60
2004/0200321 A1 * 10/2004 Chen ..... 81/63.1
2004/0216564 A1 * 11/2004 Chen ..... 81/63.1

* cited by examiner

*Primary Examiner*—Joseph J. Hail, III
*Assistant Examiner*—Bryan Muller
(74) *Attorney, Agent, or Firm*—Charles E. Baxley

(57) ABSTRACT

A ratchet wrench includes a handle and an annular head formed on the handle. The annular head defines a first space, a second space in communication with the first space and a third space in communication with the second space. An annular gear is positioned rotationally in the first space. In the second space is a direction controller including two pawls and a spring between the pawls. Partially in the third space is a direction switch for engaging selective one of the pawls with the annular gear. The direction switch defines a recess. On the annular head is a spring-biased rod detent for automatic insertion into the recess after the direction switch is moved partially in the third space, thus locking the direction switch to the annular head while allowing the rotation of the direction switch on the annular head.

8 Claims, 9 Drawing Sheets

RATCHET WRENCH

This Nonprovisional application claims priority under 35 U.S.C. § 119(a) on Patent Application No(s). 92119645 filed in TAIWAN, R.O.C. on Jul. 18, 2003, the entire contents of which are hereby incorporated by reference.

FIELD OF INVENTION

The present invention relates to a ratchet wrench.

BACKGROUND OF INVENTION

Referring to FIGS. 7~10, a conventional ratchet wrench 50 includes a handle 52 and an annular head 54 formed at an end of the handle 52. The annular head 52 defines a circular space 56, a crescent space 58 communicated with the circular space 56, a groove 60 in a side thereof and a recess 62 communicated with the groove.

A spring 64 and a ball detent 66 are put in the recess 62.

A direction switch 68 is put in and can be moved along the groove 60. A friction plate 70 is formed on the direction switch 68 for frictional contact with a user's finger. The direction switch 68 defines two recesses 72 and 74 in a side and a space 76 in an opposite side. The ball detent 66 is put in the recess 72 or 74 for keeping the direction switch 68 in one of two positions. The friction plate 70 defines an aperture 80 communicated with the space 76.

A V-shaped elastic element 80 includes two helical ends 82 and 84. The V-shaped elastic element 78 is put in the space 76.

As best shown in FIG. 8, a tab 86 is inserted in the space 76 for preventing the elastic element 80 from faltering in the space 76. The tab 86 defines an aperture 88.

A pin 90 is fit in the apertures 78 and 88 and put between the helical ends 82 and 84 so as to avoid the elastic element 80 escaping the space 76.

A pawl 92 includes two recesses 94 and 96 defined in a side and teeth 98 formed on an opposite side. The pawl 92 is put in the crescent space 58. The helical end 82 can be put in the recess 94, or the helical end 84 in the recess 96.

An annular gear 100 is put in the circular space 56. The annular gear 100 includes teeth 102 formed on an external side thereof for engagement with the teeth 98.

Referring to FIG. 9, the direction switch 68 is moved to a right-hand end of the groove 60 so that the ball detent 66 enters the recess 74. Via the elastic element 80, a right-hand end of the pawl 92 is moved to a right-hand end of the crescent space 58. Thus, the annular head 10 can drive the annular gear 100 clockwise, but not vice versa.

Referring to FIG. 10, the direction switch 68 is moved to a left-hand end of the groove 60 so that the ball detent 66 enters the recess 74. Via the elastic element 80, a left-hand end of the pawl 92 is moved to a left-hand end of the crescent space 58. Thus, the annular head 10 can drive the annular gear 100 counterclockwise, but not vice versa.

This conventional ratchet wrench 50 includes many elements. Many of its elements require fine fabrication, e.g., the direction switch 68 and the elastic element 80. It takes a lot of time to fabricate these elements. It also takes a lot time to assemble these elements. This conventional ratchet wrench 50 is very complicated in structure. As result, the cost of manufacturing of this conventional ratchet wrench 50 is high.

The present invention is therefore intended to obviate or at least alleviate the problems encountered in prior art.

SUMMARY OF INVENTION

It is the primary objective of the present invention to provide a structurally simple ratchet wrench.

According to the present invention, a ratchet wrench includes a handle and an annular head formed on the handle. The annular head defines a first space, a second space in communication with the first space and a third space in communication with the second space. An annular gear is positioned rotationally in the first space. In the second space is a direction controller including two pawls and a spring between the pawls. Partially in the third space is a direction switch for engaging selective one of the pawls with the annular gear. The direction switch defines a recess. On the annular head is a spring-biased rod detent for automatic insertion into the recess after the direction switch is moved partially in the third space, thus locking the direction switch to the annular head while allowing the rotation of the direction switch on the annular head.

Other objects, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
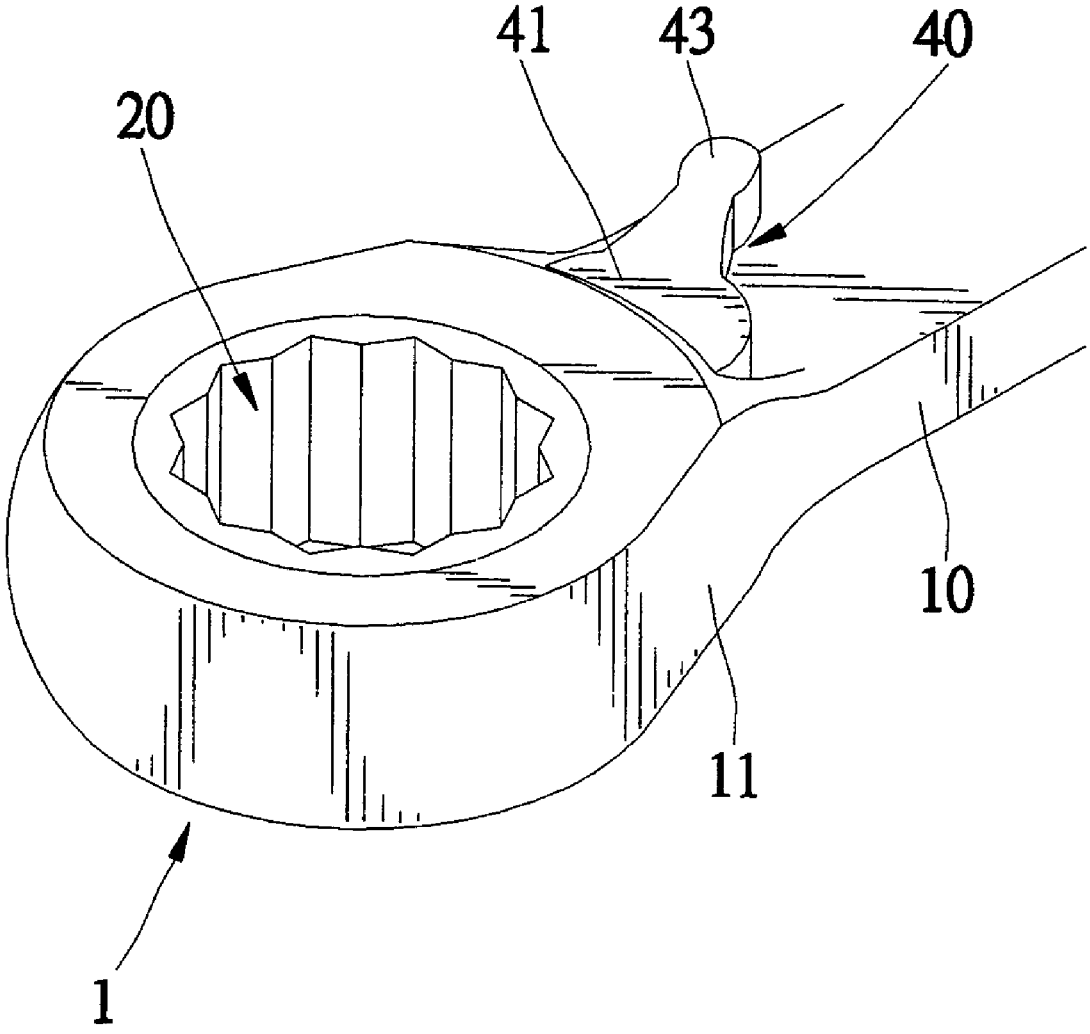
FIG. 1 is a perspective view of a ratchet wrench according to the preferred embodiment of the present invention.

Referring to FIG. 1, according to the preferred embodiment of the present invention, a ratchet wrench 1 includes a handle 10 and an annular head 11 from which the handle 10 projects.

Figure 2:
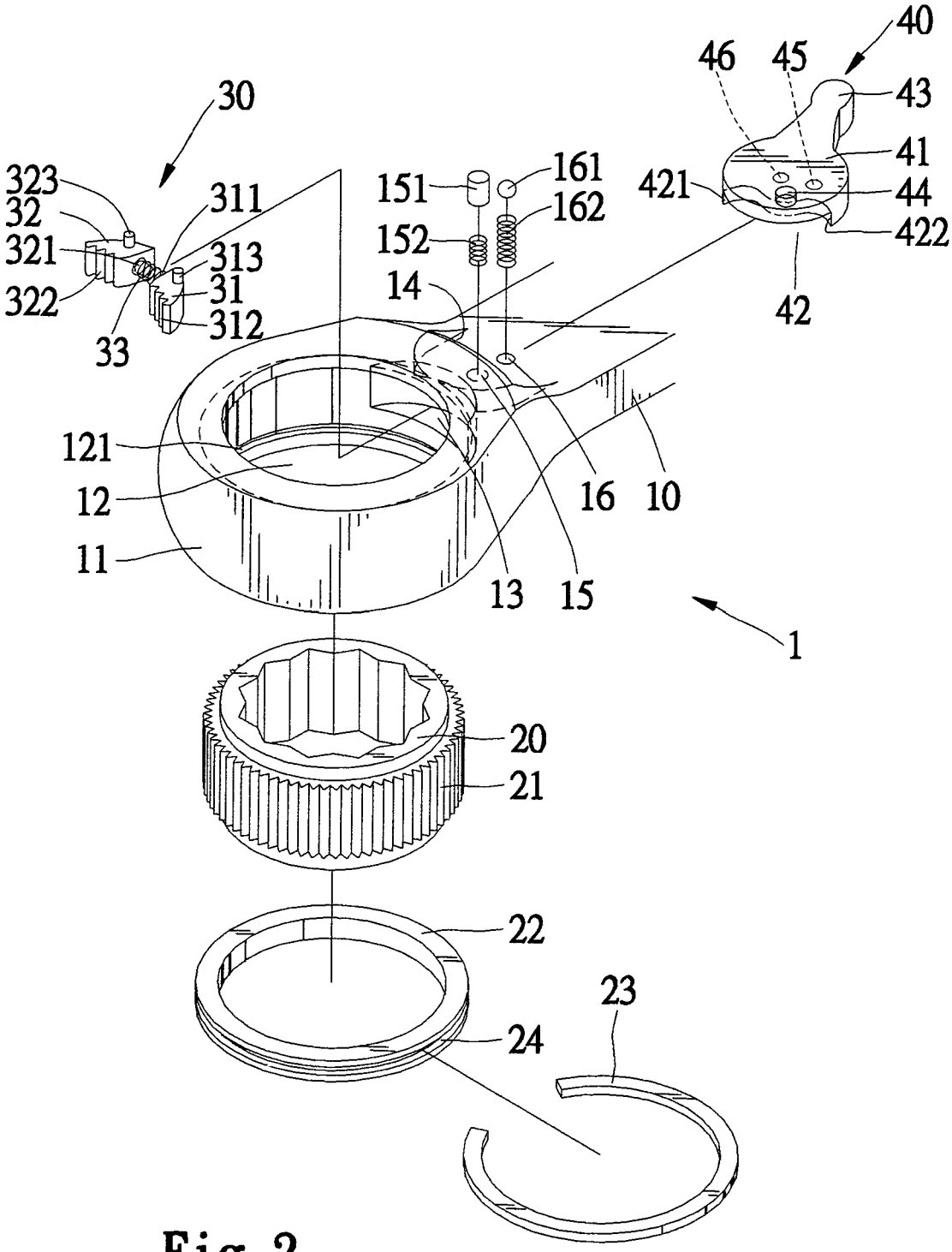
FIG. 2 is an exploded view of the ratchet wrench of FIG. 1.
Figure 3:
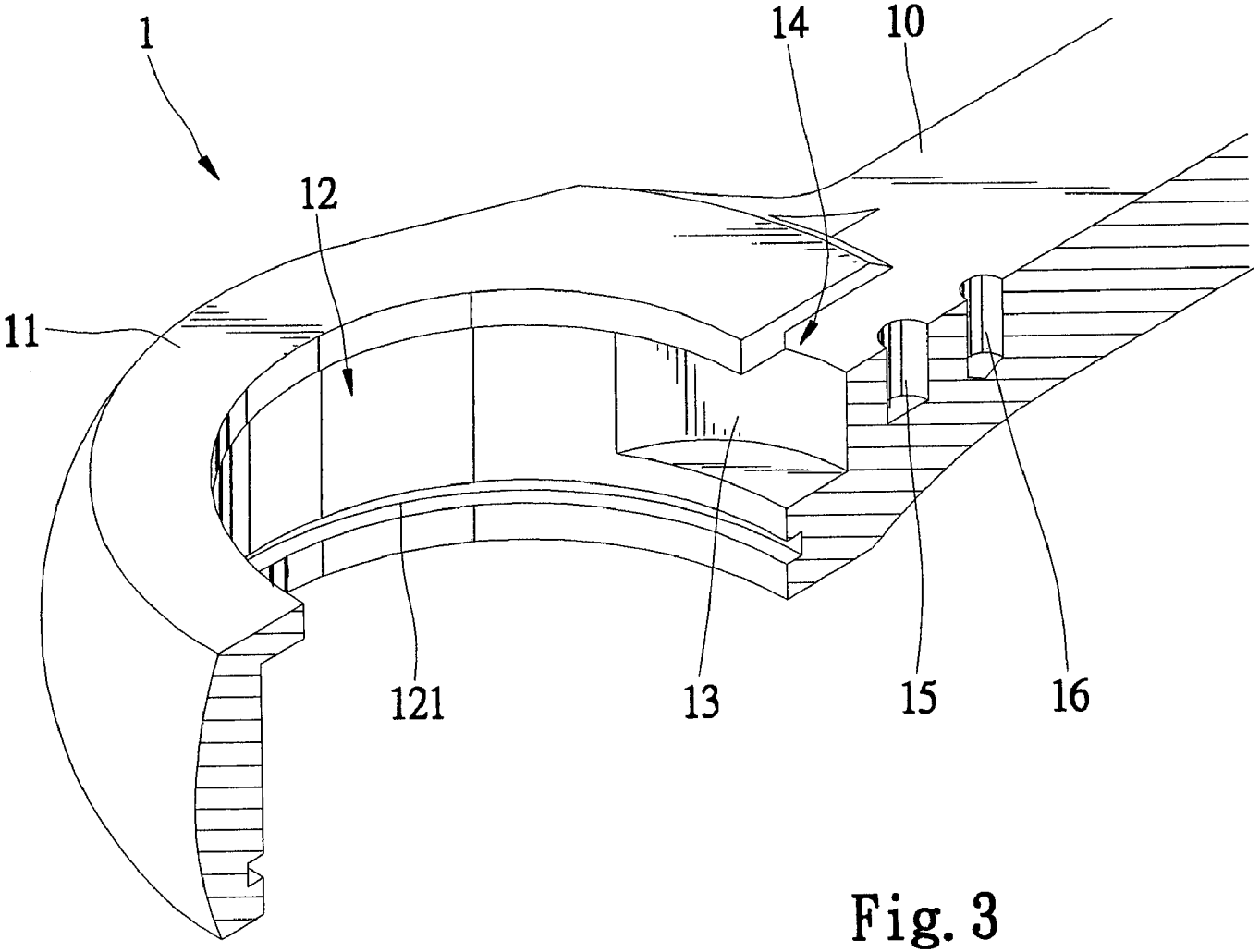
FIG. 3 is a cutaway view of the ratchet wrench of FIG. 1.

Referring to FIGS. 2 and 3, the annular head 11 defines a circular space 12, a crescent space 13 communicated with the circular space 12 and a semi-circular space 14 communicated with the crescent space 13. An annular groove 121 is defined in the wall of the circular space 12. Two recesses 15 and 16 are defined in the handle 10 near the semi-circular space 14.

A direction controller 30 is put in the crescent space 13. The direction controller 30 includes two pawls 31 and 32 and a spring 33 for connecting the pawl 31 with the pawl 32.

The pawl 31 includes a top, a bottom, a planar side, a toothed side 312, an arched side, a boss 311 formed on the planar side and rod 313 formed on the top.

The pawl 32 includes a top, a bottom, a planar side, a toothed side 322, an arched side, a boss 321 formed on the planar side and rod 323 formed on the top.

The spring 33 includes an end in which the boss 311 is fit and an opposite end in which the boss 321 is fit. Thus, the pawl 31 is firmly connected with the pawl 32 by means of the spring 33.

Figure 4:
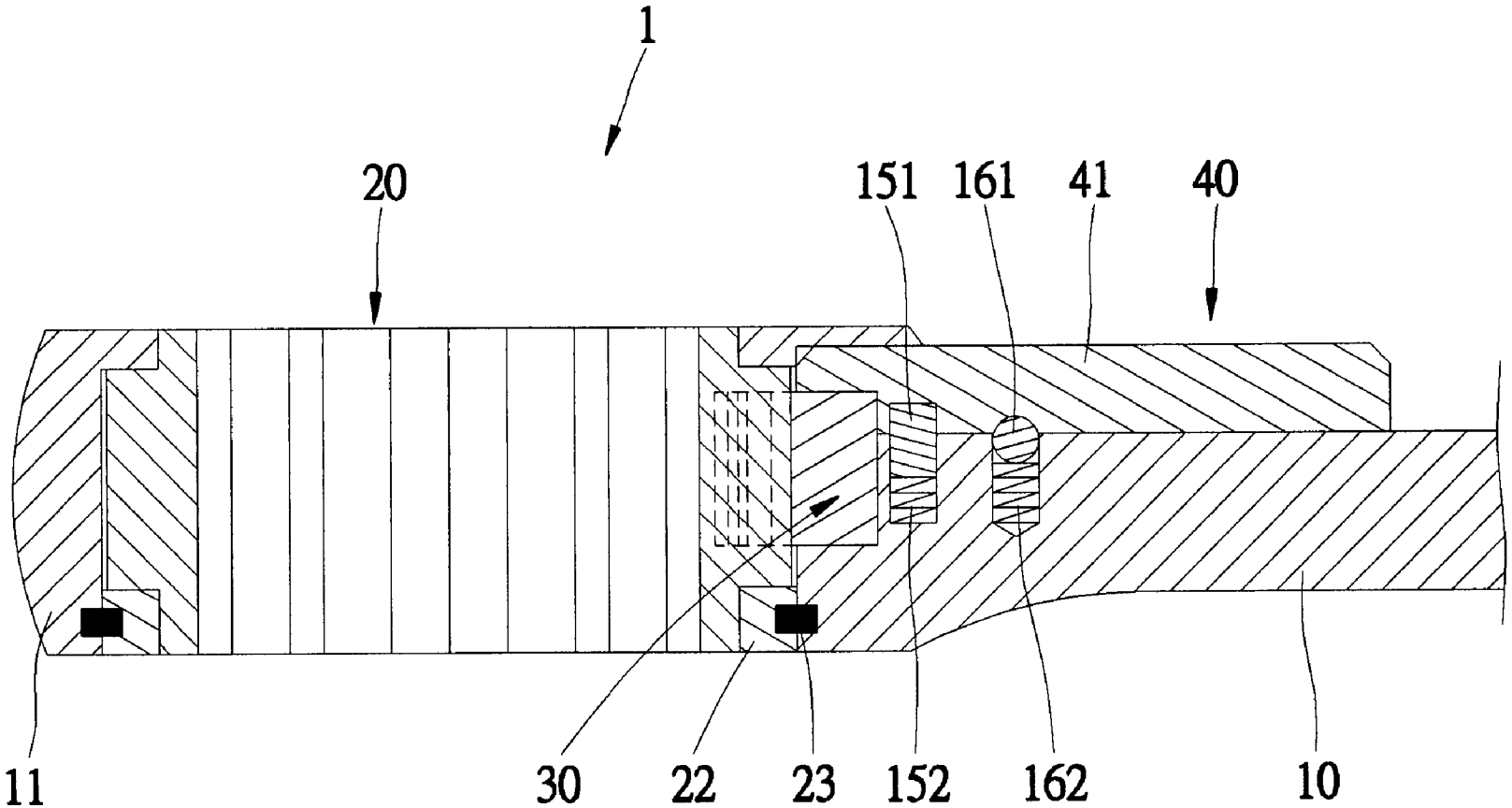
FIG. 4 is a cross-sectional view of the shown in FIG. 1.

Referring to FIGS. 2 and 4, an O-ring 22 is put in the circular space 12. The O-ring 22 includes an annular groove 24 defined in an external face thereof.

A C-ring 23 includes an internal edge put in the annular groove 24 and an external edge put in the annular groove 121. Thus, the O-ring 22 is firmly attached to the annular head 11 by means of the C-ring 23.

An annular gear 20 is put in the circular space 12. The annular gear 20 is put on the O-ring 22 rotationally. The annular gear 20 includes a toothed internal face for engagement with a bolt or nut and a toothed external face 21 for selective engagement with the pawl 31 or 32.

A spring 152 and a rod detent 151 are put in the recess 15.

A spring 162 and a ball detent 162 are put in the recess 16.

A direction switch 40 includes a disc 41 and a lever 43 extending from the disc 41. The disc 41 includes a bottom in which a space 42, a recess 44, two recesses 45 and 46 are defined. The wall of the space 42 includes a first end 421 and a 422. The disc 41 is put in the semi-circular space 14. The rod detent 151 extends into the recess 44. Thus, the direction switch 40 is installed on the handle 10 and the annular head 11 rotationally. The ball detent 16 selectively enter the recess 45 or 46.

Figure 5:
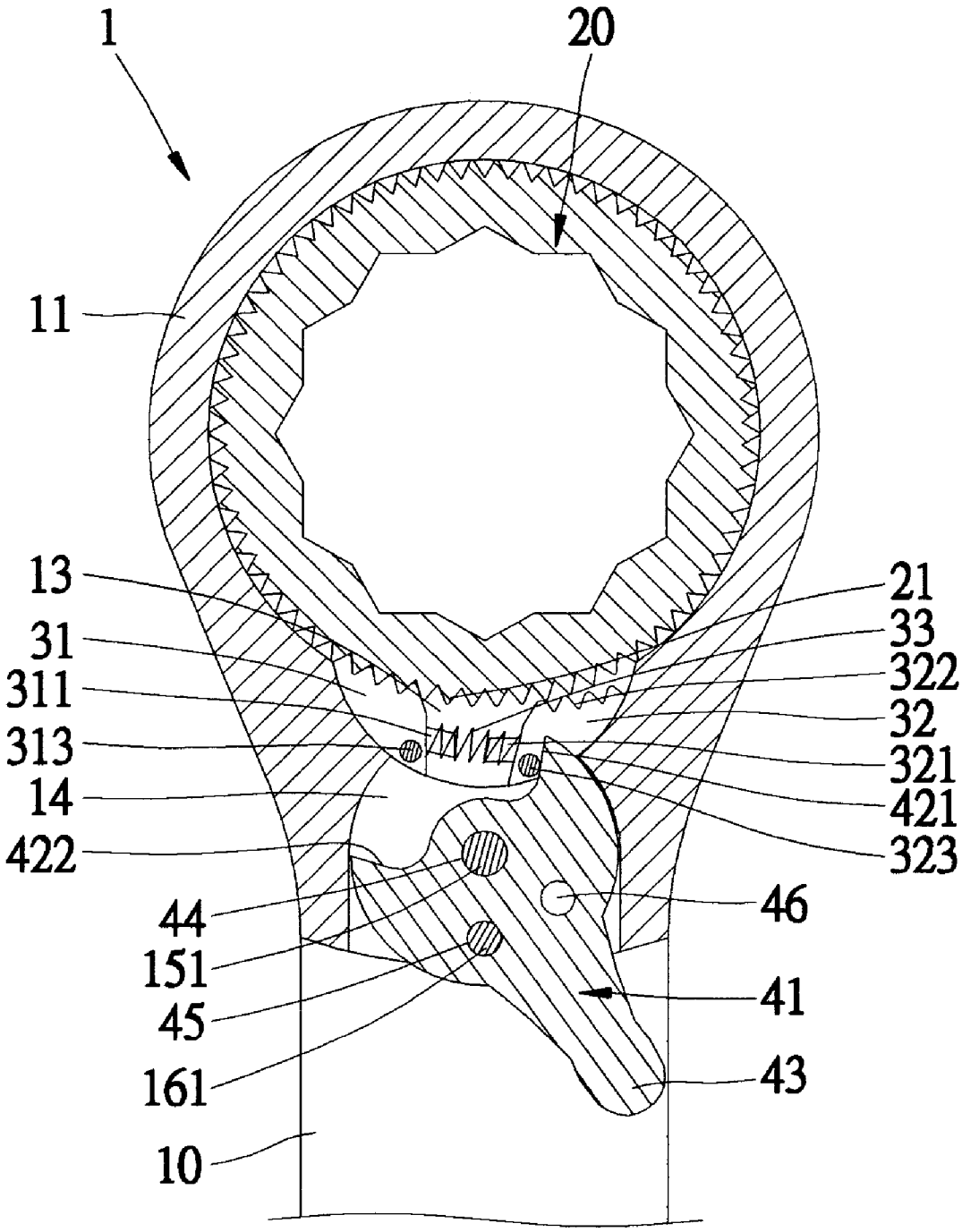
FIG. 5 is a cross-sectional view of the ratchet wrench of FIG. 11 in a position for driving a bolt or nut counterclockwise.

Referring to FIG. 5, the direction switch 40 is in a first position. The ball detent 16 enters the recess 46 so as to retain the direction switch 40 in the first position. The first end 421 of the wall of the space 42 pushes the rod 323. Thus, the pawl 31 is moved into a left-hand end of the crescent space 13. Thus, the annular head 11 can drive the annular gear 20 counterclockwise, but not vice versa.

Figure 6:
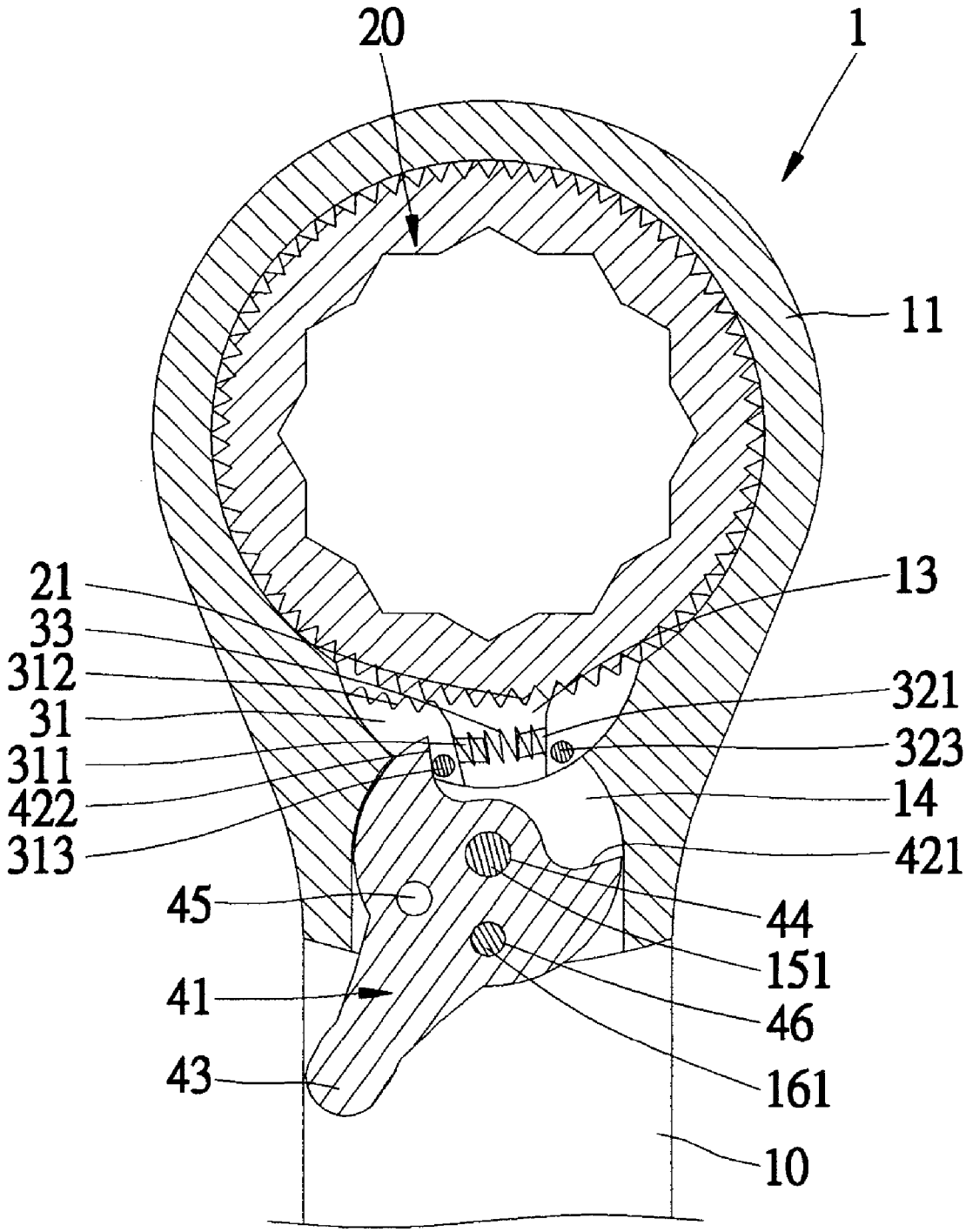
FIG. 6 is similar to FIG. 5 but showing the ratchet wrench in a position for driving a bolt or nut clockwise.
Figure 7:
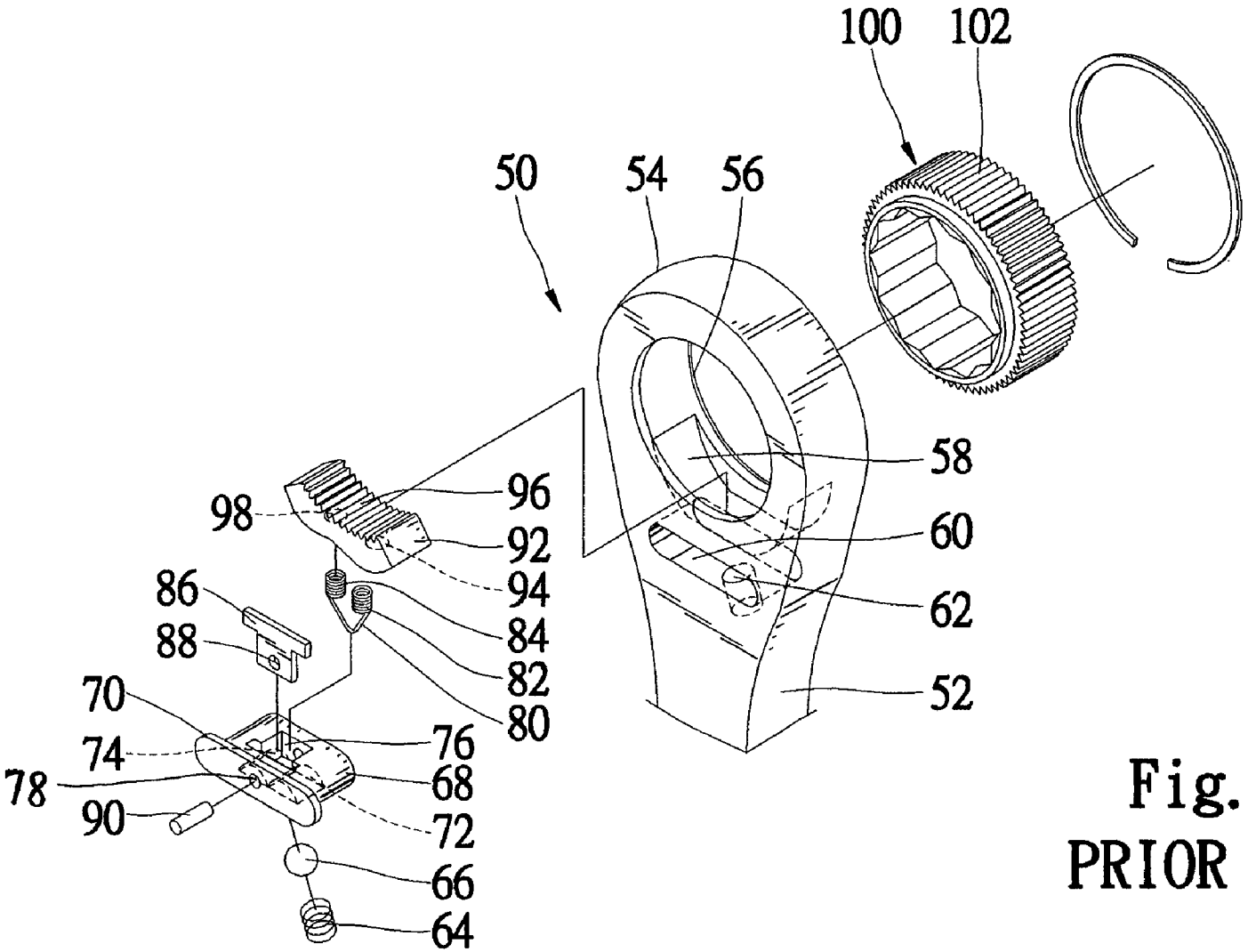
Fig. 7 PRIOR ART
FIG. 7 is an exploded view of a ratchet wrench according to prior art.
Figure 9:
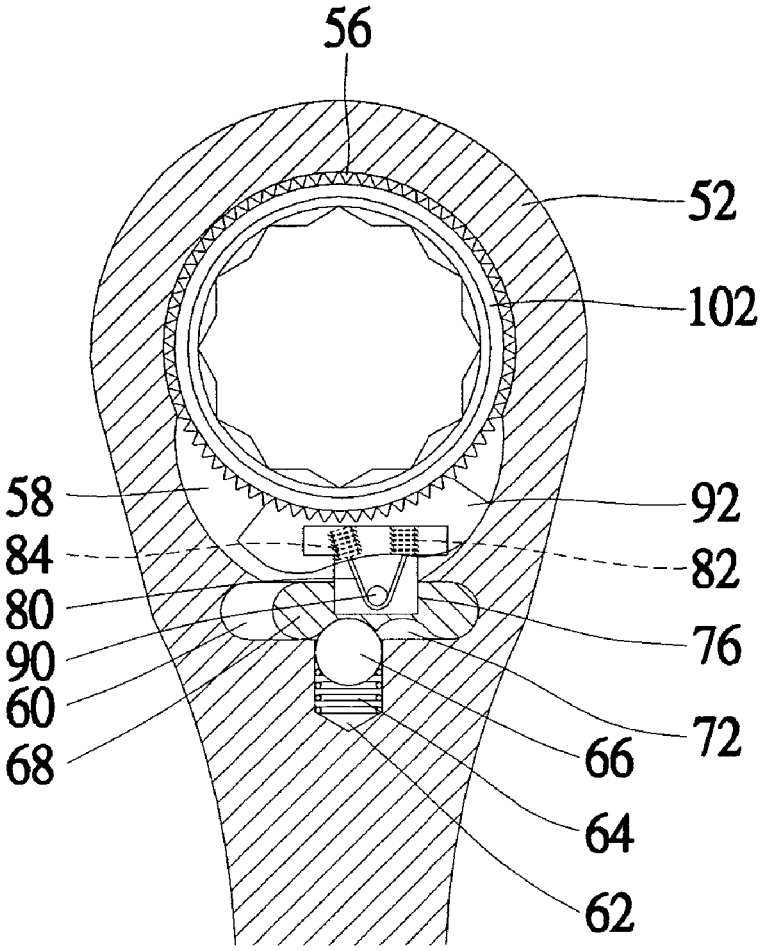
Fig. 9 PRIOR ART
FIG. 9 is a cross-sectional view of the ratchet wrench of FIG. 7 in a position for driving a bolt or nut clockwise.
Figure 8:
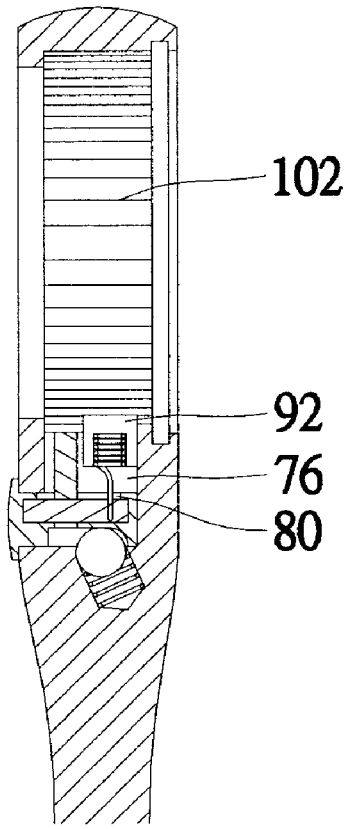
Fig. 8 PRIOR ART
FIG. 8 is a cross-sectional view of the ratchet wrench of FIG. 7.
Figure 10:
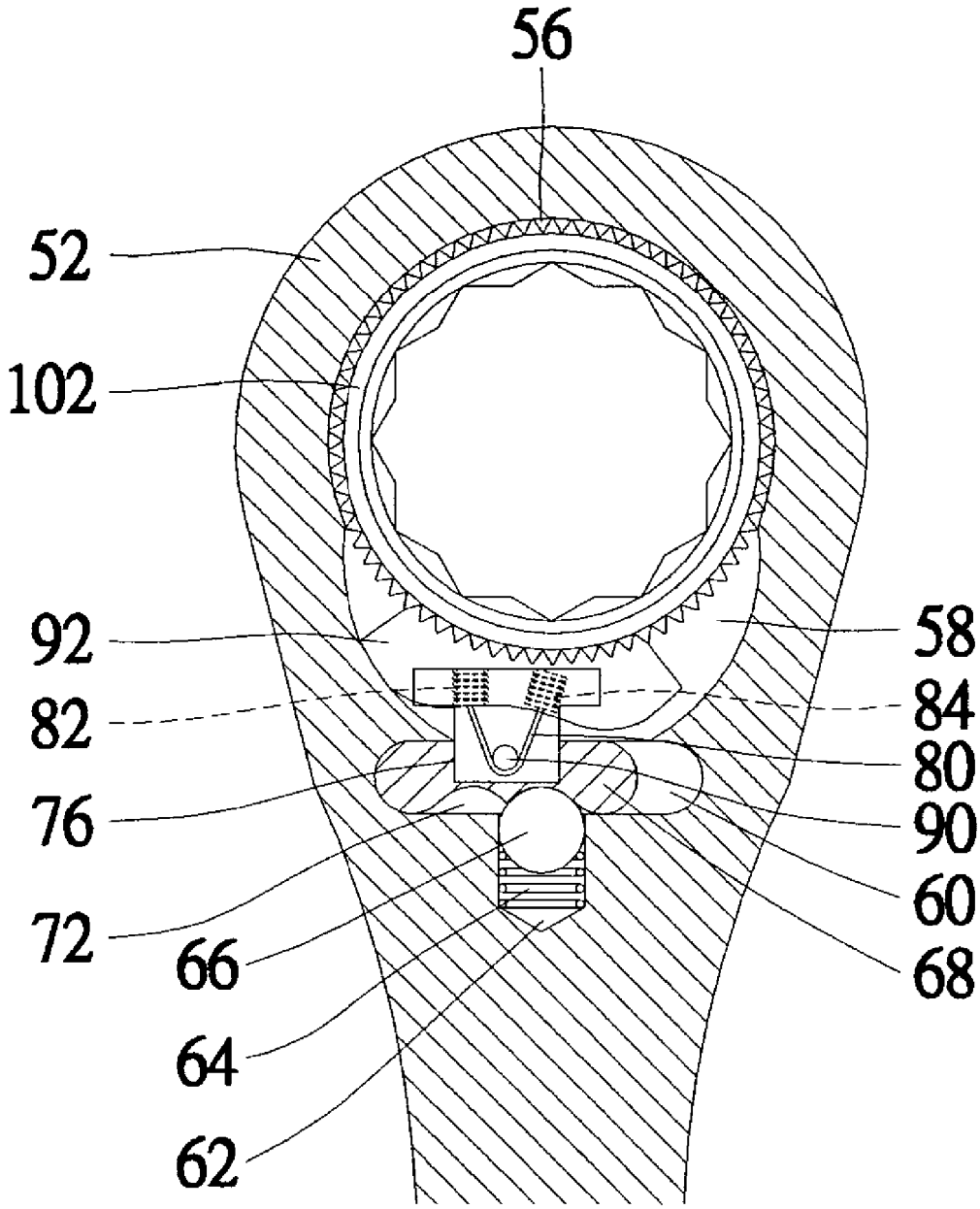
Fig. 10 PRIOR ART
FIG. 10 is similar to FIG. 9 but showing the ratchet wrench in a position for driving a bolt or nut counterclockwise.

Referring to FIG. 6, the direction switch 40 is in a second position. The ball detent 16 enters the recess 46 so as to retain the direction switch 40 in the second position. The second end 422 of the wall of the space 42 pushes the rod 323. Thus, the pawl 32 is moved into a right-hand end of the crescent space 13. Thus, the annular head 11 can drive the annular gear 20 clockwise, but not vice versa.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A ratchet wrench comprising:

a handle;

an annular head formed on the handle, the annular head defines a first space, and a second space communicated with the first space and a third space in communication with the second space;

an annular gear positioned rotationally in the first space;

a direction controller positioned in the second space, the direction controller comprising two pawls and a spring installed between the pawls;

a direction switch positioned partially in the third space for engaging selective one of the pawls with the annular gear, the direction switch defining a recess; and a spring-biased rod detent positioned on the annular head for automatic insertion into the recess when the direction switch is moved partially into the third space, thus locking the direction switch partially within the third space while allowing the rotation of the direction switch on the annular head.

2. The ratchet wrench according to claim 1 wherein each of the pawls includes a boss formed thereon and fit in an end of the spring so that it is firmly connected with the spring.

3. The ratchet wrench according to claim 1 including an O-ring fit in the first space for supporting the annular gear.

4. The ratchet wrench according to claim 3 including a C-ring, wherein the annular head defines an annular groove in an internal side for receiving an external edge of the C-ring, and the O-ring defines an annular groove in an external side for receiving an internal edge of the C-ring.

5. The ratchet wrench according to claim 1 comprising a spring-biased ball detent, wherein the handle defines a recess for receiving the spring-biased ball detent, and the direction switch defines two recesses selective one of which receives the spring-biased ball detent so that the direction switch is retained in selective one of two positions.

6. The ratchet wrench according to claim 1 wherein the direction switch comprises a disc positioned partially in the third space for engaging selective one of the pawls with the annular gear.

7. The ratchet wrench according to claim 6 wherein each of the pawls comprises a rod, wherein the disc defines a space with a wall comprising two ends, selective one of said ends can engage the rod of a respective one of the pawls in order to disengage the respective pawl from the annular gear.

8. The ratchet wrench according to claim 6 wherein the direction switch comprises a lever extending from the disc.

* * * * *